US010478022B2

(12) United States Patent
Duarte et al.

(10) Patent No.: US 10,478,022 B2
(45) Date of Patent: Nov. 19, 2019

(54) ON DEMAND WET WIPE DISPENSING DEVICE

(71) Applicant: The Clorox Company, Oakland, CA (US)

(72) Inventors: Aidee Duarte, Pleasanton, CA (US); Damon Campbell, Pacific Grove, CA (US); Tim Lau, Fremont, CA (US); Roger Sharpe, Mountain View, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 15/604,497

(22) Filed: May 24, 2017

(65) Prior Publication Data

US 2018/0338650 A1 Nov. 29, 2018

(51) Int. Cl.

| | |
|---|---|
| ***A47K 10/38*** | (2006.01) |
| ***B05B 11/00*** | (2006.01) |
| *A47K 10/32* | (2006.01) |

(52) U.S. Cl.

CPC ..... *A47K 10/38* (2013.01); *A47K 2010/3233* (2013.01); *A47K 2010/3266* (2013.01); *B05B 11/3035* (2013.01); *B05B 11/3084* (2013.01)

(58) Field of Classification Search

CPC ..... A47K 2010/328; A47K 2010/3233; A47K 2010/3266; A47K 2010/3863

See application file for complete search history.

(56) References Cited

U.S. PATENT DOCUMENTS

| | | | | |
|---|---|---|---|---|
| 2,789,725 | A * | 4/1957 | Carper | A47K 10/427 206/233 |
| 3,517,855 | A * | 6/1970 | Hillis | B42F 7/14 221/259 |
| 3,865,271 | A * | 2/1975 | Gold | A47K 10/32 221/96 |
| 4,598,664 | A | 7/1986 | Hamlin | |
| 4,667,846 | A | 5/1987 | Marceau | |
| 5,244,263 | A * | 9/1993 | Kennedy | A47K 10/28 226/131 |
| 5,988,371 | A | 11/1999 | Paley et al. | |
| 6,170,426 | B1 * | 1/2001 | Thorsbakken | A47K 10/32 118/43 |
| 6,346,153 | B1 * | 2/2002 | Lake | A47K 10/32 118/419 |
| 6,601,737 | B1 | 8/2003 | Sandler | |

(Continued)

FOREIGN PATENT DOCUMENTS

| | | | |
|---|---|---|---|
| CN | 103027622 | B | 5/2015 |
| WO | 2018022621 | A1 | 2/2018 |

*Primary Examiner* — Gene O Crawford
*Assistant Examiner* — Kelvin L Randall, Jr.
(74) *Attorney, Agent, or Firm* — Erin Collins

(57) ABSTRACT

In one example, a wipe dispensing system includes a housing that defines an internal wipe storage area, a lid rotatably connected to the housing, a fluid reservoir disposed within the housing, and a pump in fluid communication with the fluid reservoir. A fluid discharge manifold is in fluid communication with the pump and is arranged proximate to a portion of a wipe dispensing path. The lid is operably disposed with respect to the pump such that depression of the lid causes discharge of fluid from the pump through the fluid discharge manifold, and also causes partial dispensation of a wipe from the housing.

10 Claims, 12 Drawing Sheets

(56) References Cited

U.S. PATENT DOCUMENTS

| | | | | |
|---|---|---|---|---|
| 7,318,949 | B2 * | 1/2008 | Shadrach, III | A47K 10/3818 118/315 |
| 7,497,351 | B2 | 3/2009 | Amundson et al. | |
| 7,654,412 | B2 | 2/2010 | Amundson et al. | |
| 7,984,832 | B2 | 7/2011 | Pivonka et al. | |
| 8,006,864 | B2 | 8/2011 | Fryan et al. | |
| 8,177,156 | B1 * | 5/2012 | Rinne | A47K 10/34 242/564.4 |
| 10,029,267 | B2 * | 7/2018 | Connolly | B01J 13/18 |
| 2007/0289988 | A1 | 12/2007 | Sosalla et al. | |
| 2008/0138143 | A1 | 6/2008 | O'Connell | |
| 2008/0245821 | A1 | 10/2008 | Itzkowitz et al. | |
| 2010/0032338 | A1 | 2/2010 | Mueller et al. | |
| 2010/0032443 | A1 * | 2/2010 | Mueller | A45D 34/00 221/2 |
| 2011/0308451 | A1 * | 12/2011 | Kaufmann | A47K 10/32 118/235 |
| 2015/0173573 | A1 | 6/2015 | Dunn et al. | |
| 2015/0196173 | A1 | 7/2015 | Hoefte et al. | |
| 2015/0272404 | A1 * | 10/2015 | Jeon | A47K 10/32 222/173 |
| 2015/0366416 | A1 | 12/2015 | Hoefte et al. | |
| 2016/0174779 | A1 * | 6/2016 | Yaros | A47K 10/3818 242/594 |
| 2017/0333586 | A1 | 11/2017 | Kang et al. | |
| 2018/0010080 | A1 | 1/2018 | Kang et al. | |

* cited by examiner

ON DEMAND WET WIPE DISPENSING DEVICE

RELATED APPLICATIONS

This application is related to U.S. patent application Ser. No. 15/604,520, entitled APPARATUS FOR MULTI DOSING OF WIPE AT POINT OF DISPENSING, and filed the same day herewith. The aforementioned application is incorporated herein in its entirety by this reference.

FIELD OF THE INVENTION

Embodiments of the present invention generally concern disposable wipe dispensing devices and associated components and methods. More particularly, at least some embodiments of the invention relate to an on demand wet wipe dispensing device that separately stores disposable wipes from multiple interior reservoirs that each hold a respective fluid. The on demand wet wipe dispensing device is configured so that, in response to a single action by a user, a wipe can be dosed while it is being dispensed from the on demand wet wipe dispensing device.

BACKGROUND

Various wipe dispensing devices exist that store multiple wipes which can be dispensed one at a time by a user. Typically, the wipes are stored in the dispensing device pre-wetted with a fluid of some type. While this approach has been satisfactory in some respects, problems nonetheless remain in the art.

For example, the chemicals in the fluid used to pre-wet the wipes can degrade such that the efficacy of the fluid is reduced, or eliminated, with the passage of time. This is particularly likely to occur in the common circumstance where the wipes are dispensed only occasionally and the wipe fluid thus has a relatively long residence time in the dispenser.

A related problem is that, over time, the fluid and the wipe substrate may chemically interact with each other in such a way that the efficacy of the wipe and/or the fluid is compromised. Again, this problem may be of particular concern in the case where the wipes have a relatively long residence time in the dispenser.

As should be evident from the foregoing examples, another problem with typical wipe dispensing systems is that they lack flexibility in terms of the chemical formulations that can be employed. That is, typical wipe dispensing systems are constrained to a limited number of types of chemical formulations for the fluid, since the fluid is required to remain relatively efficacious over a long period of time, and cannot have adverse interactions with the wipe substrate material. Corresponding restrictions are imposed on the wipes as well. That is, the wipes must be made of a substrate material that does not significantly degrade when exposed to the fluid for long periods of time.

Typical wipe dispensing systems lack flexibility in other regards as well. For example, it is sometimes the case that a fluid combination is relatively more efficacious than its individual components considered separately. However, such fluid combinations may be efficacious for only a limited period of time. Consequently, it may not be practical to use wipes pre-wetted with such fluid combinations in typical wipe dispensing systems, since the fluid on the wipe may reside in the dispensing system for a period of time longer than its useful life.

In light of problems such as those noted above, it would be useful to provide a wipe dispensing system that enables use of various combinations of fluids. It would also be useful to provide a wipe dispensing system that enables relatively long term storage of the wipes and fluids without material degradation of either.

Aspects of an Example Embodiment

Embodiments within the scope of the invention may be effective in overcoming one or more of the problems in the art, although it is not required that any embodiment resolve any particular problem(s). In general, embodiments of the present invention concern disposable wipe dispensing systems and associated components and methods. More particularly, at least some embodiments of the invention relate to an on demand wet wipe dispensing device that separately stores disposable wipes from multiple interior reservoirs that each hold a respective fluid. A single action by a user causes operation of pumps associated with a respective fluid reservoir so that fluid from each of the fluid reservoirs is directed onto the wipe as the wipe is being dispensed from the dispensing device.

In one example embodiment, an on demand wipe dispensing system, which may be referred to herein as simply a wipe dispensing system, is provided that is configured to hold wipes and one or more fluids in such a way that the wipes and each of the one or more fluids can be stored in isolation from the others within a housing of the wipe dispensing system. Some more particular embodiments include the wipes and fluids. The wipe dispensing system further includes one or more pumps disposed within the housing, and each pump is configured and arranged to pump a respective one of the fluids when the fluid is present in the housing. The pumps are configured and arranged to operate substantially simultaneously with each other. A wipe dispensing mechanism is also provided that is operable to dispense a wipe. Simultaneous actuation of the pumps and the wipe dispensing mechanism is afforded by an actuation mechanism that is operably disposed with respect to the pumps and to the wipe dispensing mechanism.

In operation, a user can operate the actuation mechanism so that a wipe is dosed and dispensed at the same time. Both of these operations can be performed by a single user action and without requiring the user to pull on, or otherwise manipulate, the wipe. When the wipe has been dosed and dispensed, it can then be removed by the user.

Advantageously then, this example embodiment of the invention is directed to a wipe dispensing system configured to operate such that wipes can be dosed by multiple fluids and dispensed on demand by a user. The dosing and dispensing operations can be performed by a single act on the part of the user, and may be performed simultaneously with each other.

BRIEF DESCRIPTION OF THE DRAWINGS

In order to describe the manner in which at least some aspects of this disclosure can be obtained, a more particular description will be rendered by reference to specific embodiments thereof which are illustrated in the appended drawings. Understanding that these drawings depict only example embodiments of the invention and are not therefore to be considered to be limiting of its scope, some example embodiments of the invention will be described and explained with additional specificity and detail through the use of the accompanying drawings, in which.

DETAILED DESCRIPTION OF SOME EXAMPLE EMBODIMENTS

Reference will now be made in detail to aspects of various embodiments of the present disclosure, examples of which are illustrated in the accompanying drawings. While described in conjunction with these embodiments, it will be understood that they are not intended to limit the disclosure to these embodiments.

A. GENERAL ASPECTS OF SOME EXAMPLE EMBODIMENTS

Figure 1:
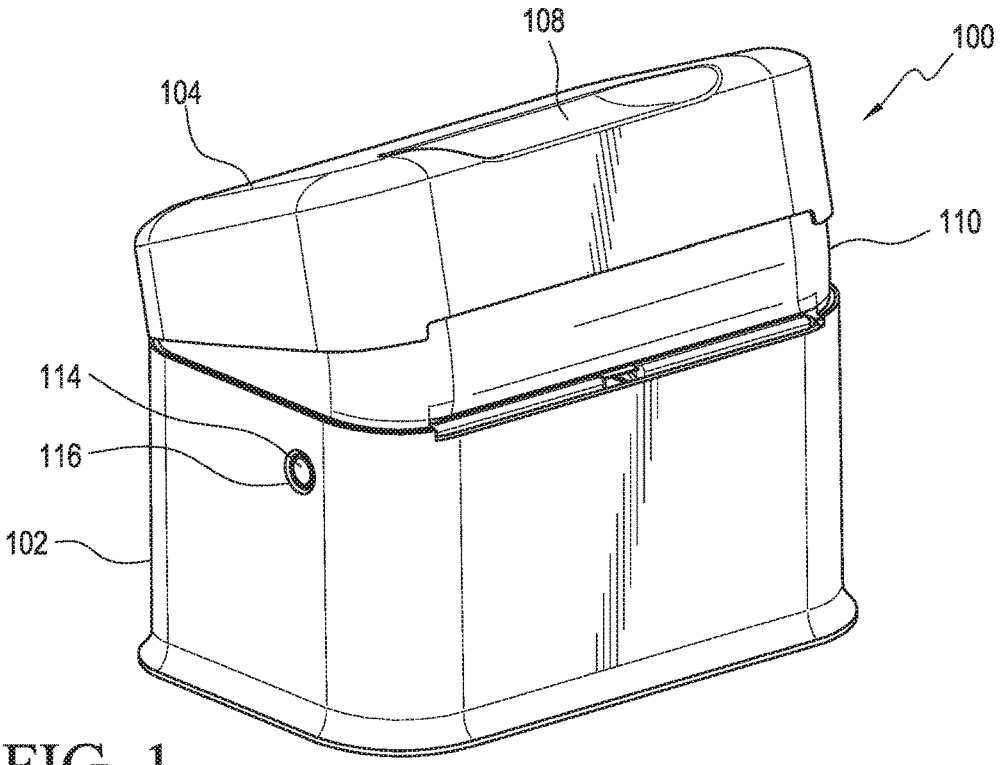
FIG. 1 is a front perspective view of an example on demand wet wipe dispensing device.
Figure 2:
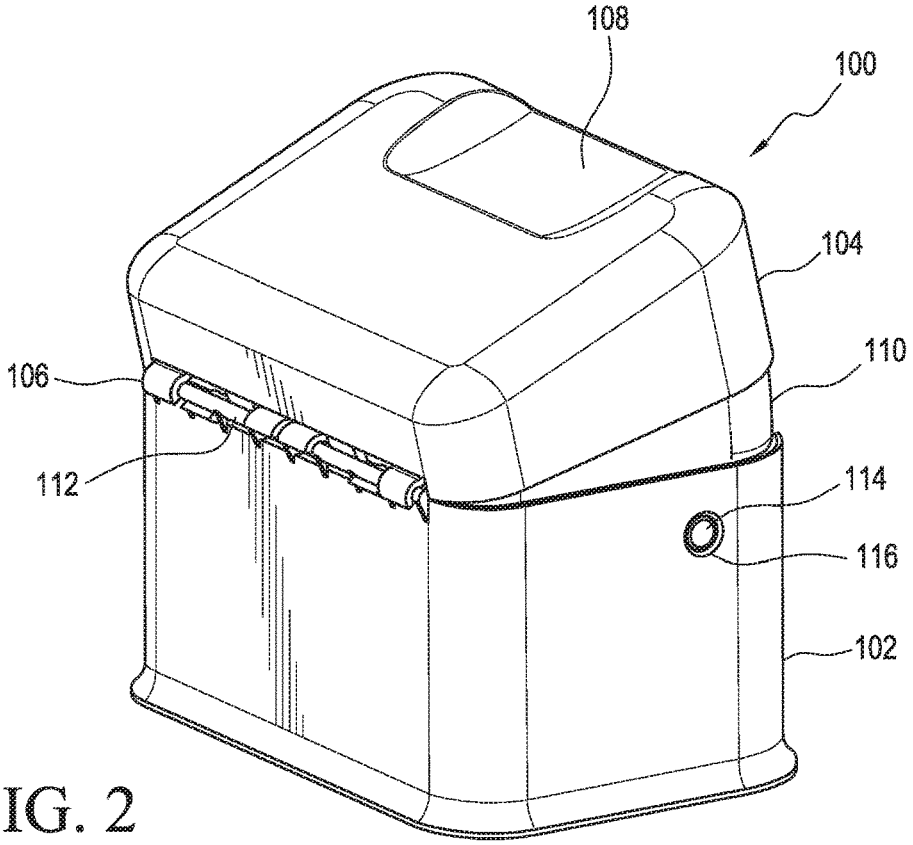
FIG. 2 is a rear perspective view of the embodiment of FIG. 1.
Figure 3:
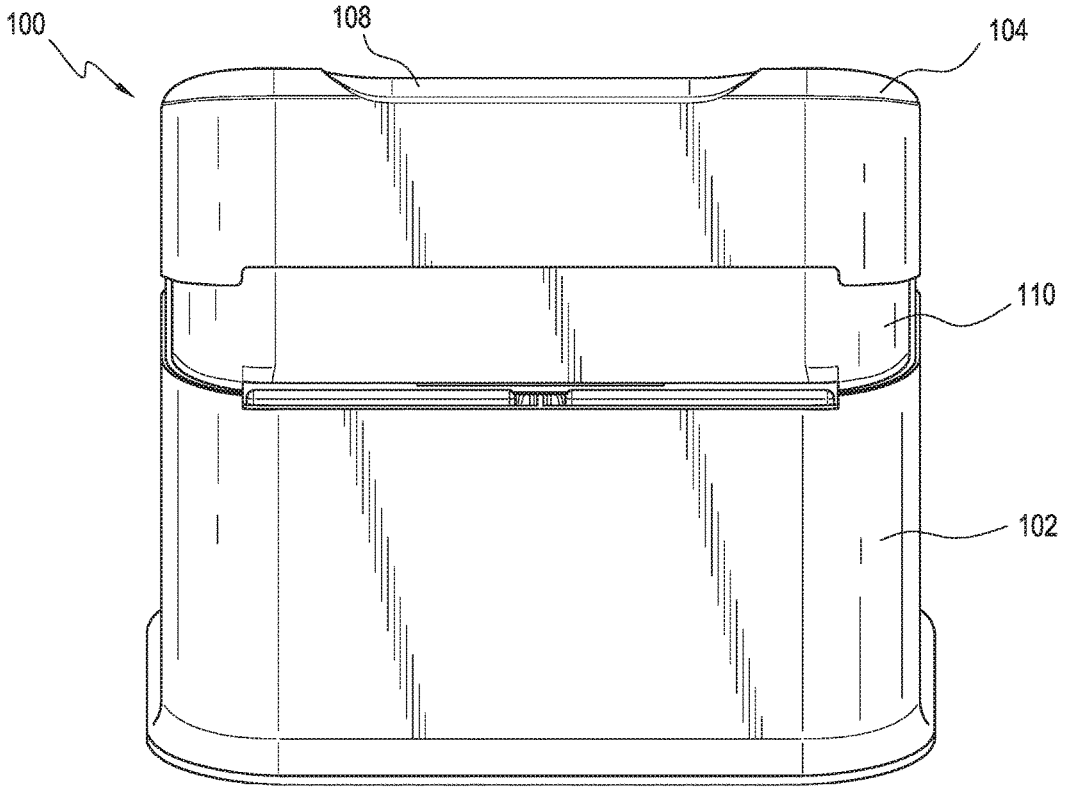
FIG. 3 is a top perspective view of the embodiment of FIG. 1.

Directing attention first to FIGS. 1-3, details are provided concerning an example on demand wet wipe dispensing system, one example of which is denoted generally at 100. For brevity, embodiments of an on demand wet wipe dispensing system may be referred to herein simply as a wipe dispensing system. As indicated, the wipe dispensing system 100 includes a housing 102, and a lid 104 configured to mate with the housing 102. The housing 102 and lid 104 can be made of plastic and/or any other suitable material(s).

The lid 104 may have a clamshell configuration and, as such, can be rotatably connected to an edge of the housing 102 by way of a hinge 106, and can be biased open, or upward, into a 'ready' position as shown in FIGS. 1-3. The biasing of the lid 104 to the 'ready' position can be effected with one or more resilient elements 107, such as one or more torsion springs for example. As best shown in FIG. 3, the lid 104 can include a user interface portion 108, in the form of a depression for example, that a user can depress to operate the wipe dispensing system 100.

In addition to the housing 102 and lid 104, the wipe dispensing system 100 further includes a housing extension 110 that is rotatably connected to the same edge of the housing 102 as the lid 104, by way of a hinge 112. As shown, the hinge 112 and hinge 106 may be configured and arranged so that the housing extension 110 and the lid 104 both rotate about the same axis.

The housing extension 110 further includes a pair of buttons 114 that are each positioned in a respective opening 116 defined by the housing 102. The buttons 114 can be disposed at or near the end of respective cantilever structures that bias the buttons 114 into the openings, but which also permit temporary movement of the buttons 114 out of the openings 116 when the bias is overcome, such as when a user depresses the buttons 114.

When thus disposed, the buttons 114 prevent movement of the housing extension 110 relative to the housing 102, and more specifically, prevent rotation of the housing extension 110 about the hinge 112. Depression of the buttons 114 moves the buttons 114 out of the openings 116, thus freeing the housing extension 110 to rotate about the hinge 112. Rotation of the housing extension 110 in this way is useful in that it enables access to the portion of the interior of the housing 102 located beneath the housing extension 110. The housing extension 110 can be rotated in this way when, for example, there is a need to replenish fluid in one or more fluid reservoirs (not shown in FIGS. 1-3) or to install a new roll of wipes (not shown in FIGS. 1-3).

B. ASPECTS OF AN EXAMPLE WIPE DISPENSING MECHANISM

Figure 4:
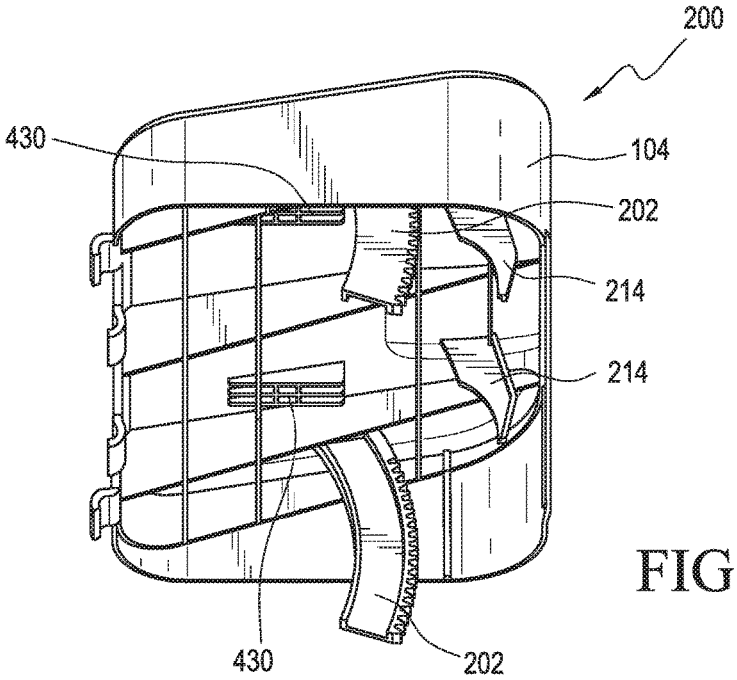
FIG. 4 is a bottom perspective view of a lid.
Figure 5:
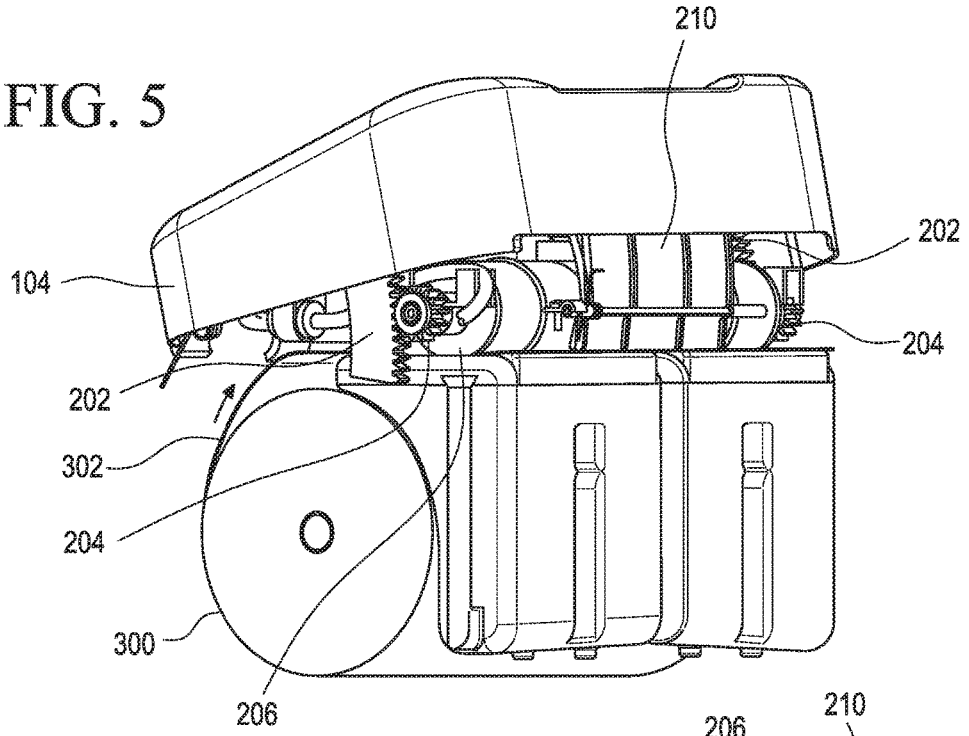
FIG. 5 is a side perspective view indicating various internal components of an example on demand wet wipe dispensing system.

Turning now to FIGS. 4-9, details are provided concerning wipe dispensing mechanisms, one example of which is denoted generally at 200. As shown in FIGS. 4-5, the lid 104 can include first and second drive gears 202 that can be integral with the lid 104, although that is not required. When the lid 104 is connected to the housing 102 as shown in FIGS. 4-5, the drive gears 202 are each configured to engage a corresponding driven gear 204 such that a downward movement of the lid 104, which can occur when a user desires to dispense a wipe, causes a counterclockwise (viewed from the perspective indicated in FIG. 4) rotation of the driven gears 204. Because the driven gears 204 are connected to respective ends of the roller 206, the downward movement of the lid 104 likewise causes a counterclockwise rotation of the roller 206. In general, the roller 206 is positioned relative to a supply 300 of wipes 302 so as to advance the wipe 302 in response to a downward movement of the lid 104.

Figure 6:
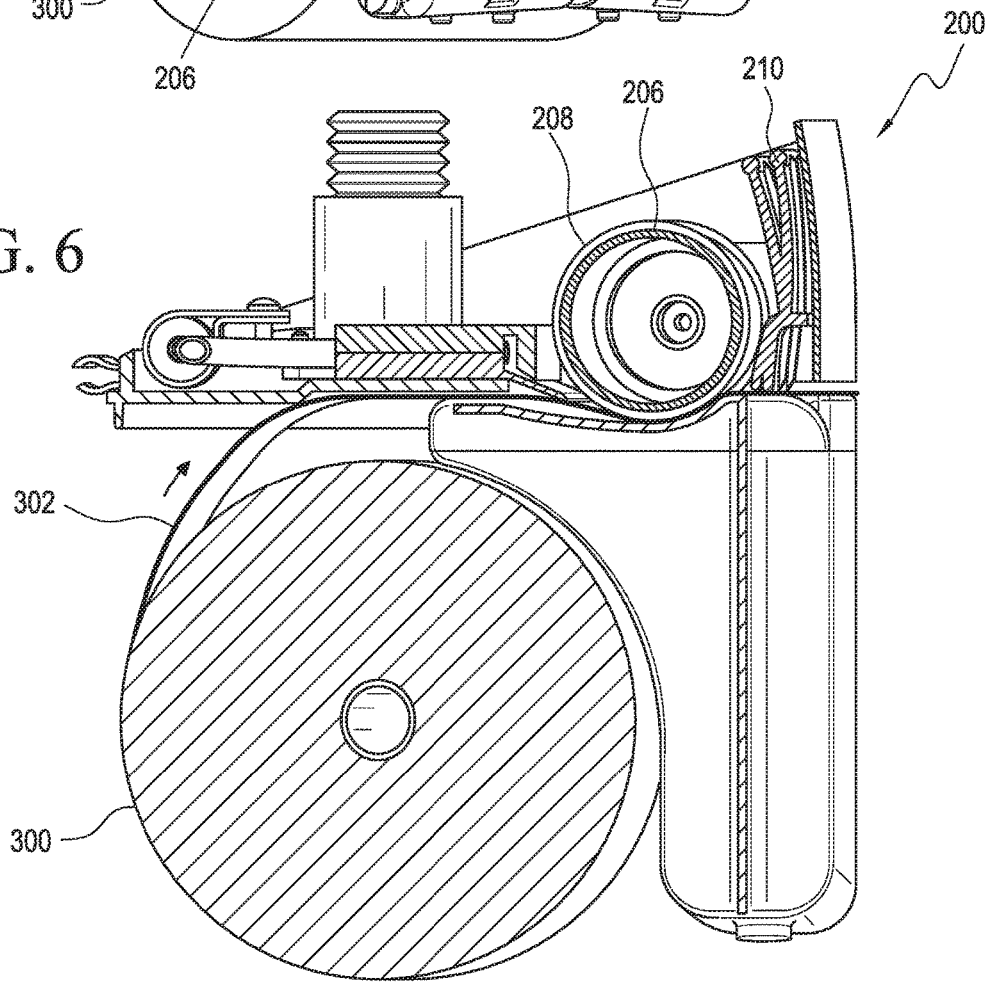
FIG. 6 is a side view indicating various internal components of an example on demand wet wipe dispensing system.

In more detail, the roller 206 includes one or more circumferential contact elements 208, which can be in the form of rubber or silicone rings for example. As shown in FIG. 6 for example, the contact elements 208 are positioned along a path of the wipe 302 and arranged for contact with the wipe 302. The friction between the contact elements 208 and the wipe 302 enables the roller 206 to advance the wipe 302 in the direction indicated by the arrows in FIGS. 5 and 6.

Figure 7:
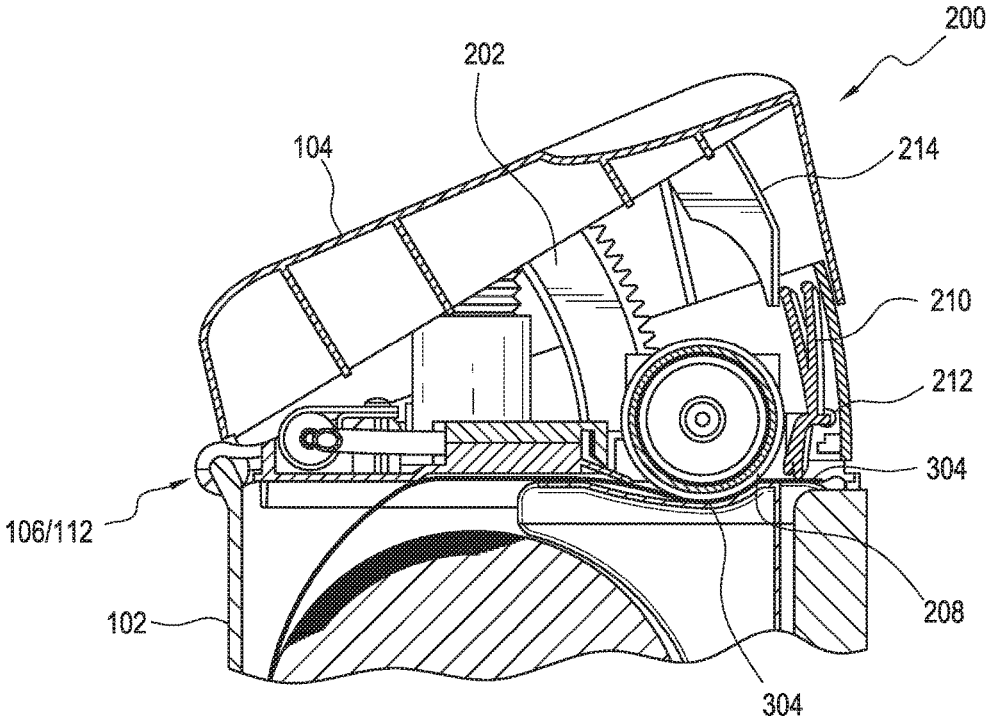
FIG. 7 is a side view detail indicating various internal components of an example on demand wet wipe dispensing system.

With particular reference now to FIGS. 4 and 7, and continued reference to FIGS. 5 and 6, the wipe dispensing mechanism 200 further includes one or more friction bars 210 that are rotatably mounted to the housing extension 110 by way of a shaft 212. The friction bar 210 can be biased by a resilient element (not shown), such as a torsion spring for example, into a position in which the lower edge of the friction bar 210 is located proximate a dispensing path 304 along which the wipe 302 travels. In this position, the friction bar 210 is in contact with the wipe 302 and thus tends to resist movement of the wipe 302 out of the housing 102. The upper edge of the friction bar 210 is configured for contact with one or more push arms 214 of the lid 104. The push arms 214 can be integral with the lid 104 but that is not required.

In general, a downward motion of the lid 104, such as may be imparted by a user desiring to dispense a wipe, moves the push arms 214 into contact with the friction bar 210, causing a clockwise (viewed from the perspective of FIG. 7) rotation of the friction bar 210 about the shaft 212. In more detail, this clockwise rotation of the friction bar 210 moves the bottom edge of the friction bar 210 up and out of the dispensing path 304 so that the wipe 302 can readily exit the housing 102 without encountering resistance from the friction bar 210. When the wipe 302 has exited the housing and the user releases the lid 104, the lid 104 returns to the 'ready' position under the influence of a spring or other resilient element, and the push arm 214 of the lid 104 moves away from the upper edge of the friction bar 210, allowing the lower edge of the friction bar 210 to come into contact with the next successive wipe 302, as shown in FIG. 7.

As a result of the force and friction exerted on the next successive wipe 302 by the friction bar 210, that wipe 302 tends to resist any movement along the dispensing path 304 and, as a result, the dispensed and dosed wipe 302 can be easily separated from the next successive wipe 102 by the user. Perforations between successive wipes 302 can further facilitate ready separation of the wipes 302 from each other.

Figure 8:
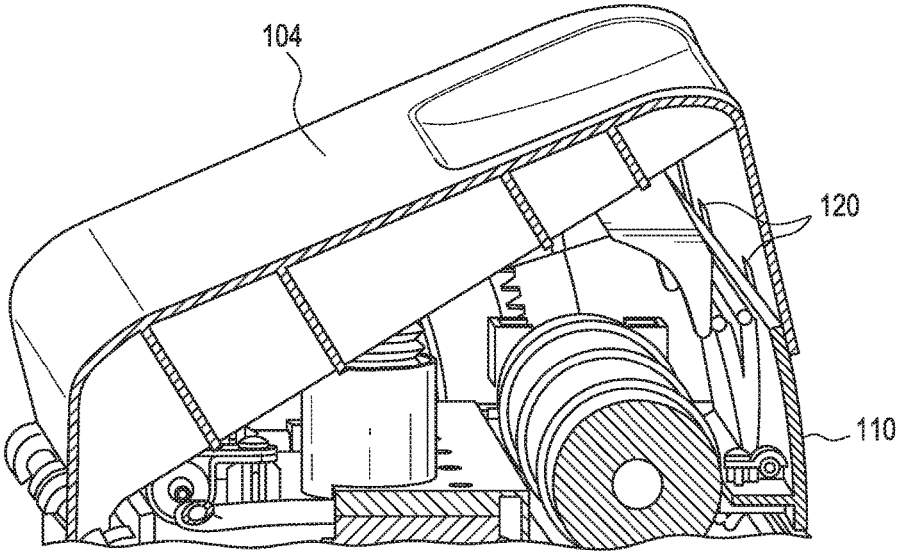
FIG. 8 is a partial side view detail indicating various internal components of an example on demand wet wipe dispensing system.
Figure 9:
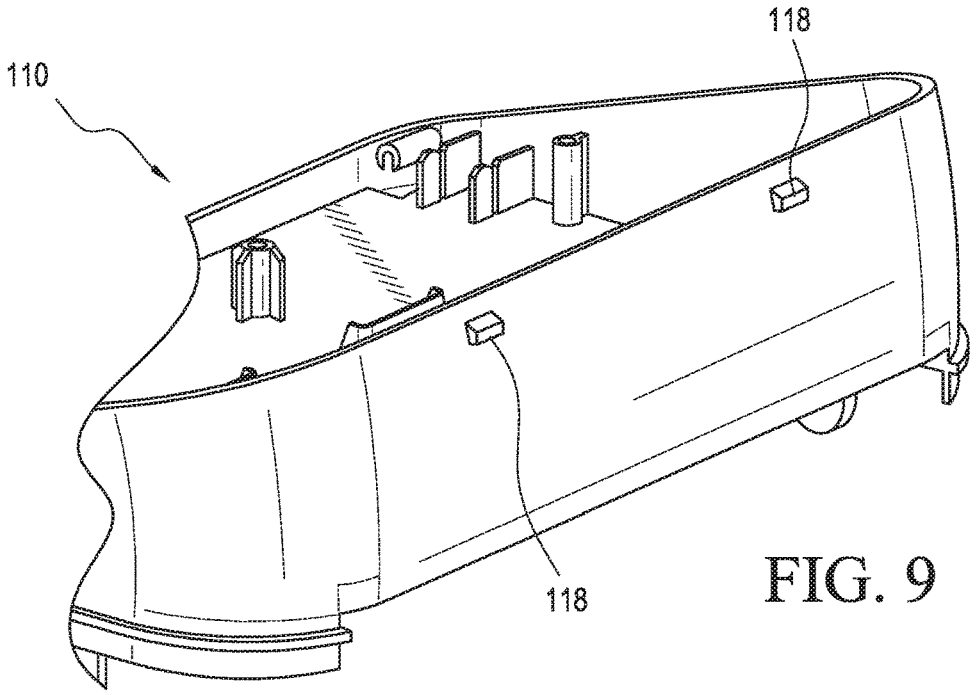
FIG. 9 is a front perspective view of an example housing extension.
Figure 10:
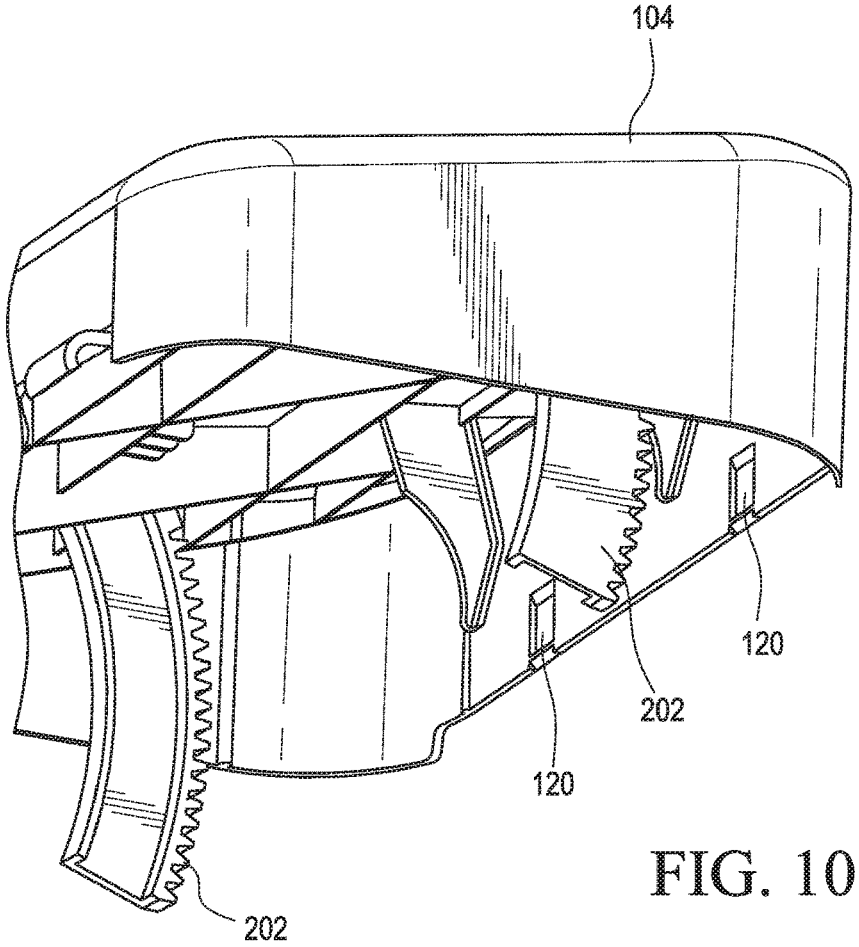
FIG. 10 is a rear perspective view of an example housing extension.

Turning now to FIGS. 8-10, further details are provided concerning the relation between the housing extension 110 and the lid 104. In particular, and as best shown in FIG. 9, the housing extension 110 includes two protruding elements 118 configured to be slidingly received in respective slots 120 defined by the lid 104. Because the slots 120 are closed at both ends, the protruding elements 118 are trapped in the slots 120. As a result of this configuration and arrangement, the range of motion of the lid 104, specifically the range of upward movement of the lid 104 away from the housing extension 110, is limited. That is, the lid 104 can only move upward until the bottom ends of the slots 120 of the lid 104 contact the protruding elements 118 of the housing extension 110, at which time no further upward movement of the lid 104 relative to the housing extension 110 is possible. As noted earlier, the lid 104 can be biased into the 'ready' position shown, for example, in FIG. 8.

C. ASPECTS OF AN EXAMPLE FLUID DISPENSING SYSTEM

Figure 11:
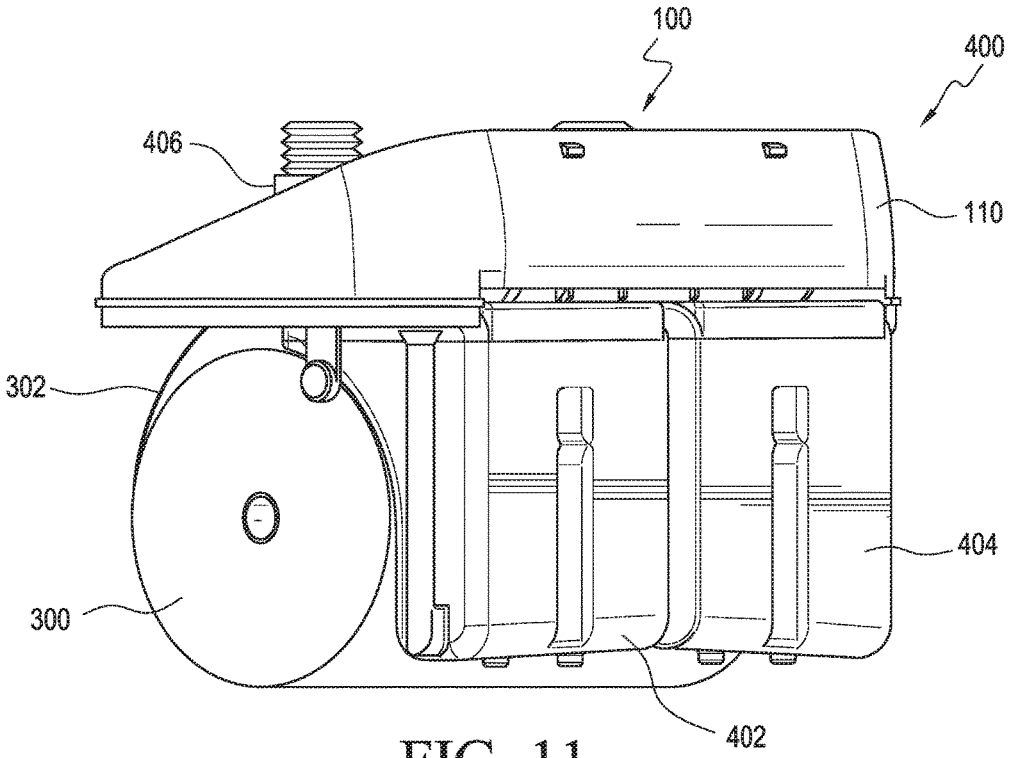
FIG. 11 is a front perspective view of various internal components of an example on demand wet wipe dispensing system.

With continued attention to FIGS. 1-8, and directing attention now to FIGS. 9-18, details are provided concerning fluid dispensing systems employed in various embodiments of the invention, where one example of such a fluid dispensing system is denoted generally at 400. In general, the fluid dispensing system 400 includes multiple fluid reservoirs, such as fluid reservoirs 402 and 404, each configured to hold a volume of fluid and isolated from each other so that fluid in one of the fluid reservoirs cannot enter the other fluid reservoir. The fluid reservoirs 402 and 404 can take various forms, such as flexible bladders or pouches, or rigid containers, for example, and the fluid reservoirs 402 and 404 are configured and arranged so that the volumes of fluid contained in the fluid reservoirs 402 and 404 have a static pressure head imposed by gravity when the wipe dispensing system 100 is oriented as shown in FIG. 11. As well, the fluid reservoirs 402 and 404 can be removable from the wipe dispensing system 100 for refilling or disposal. As noted herein, access to the fluid reservoirs 402 and 404 for the refilling and disposal processes can be gained by rotating the housing extension 110 counterclockwise, with reference to FIG. 11.

The fluid dispensing system 400 further includes multiple pumps, such as pumps 406 and 408. Each pump 406 and 408 is arranged for fluid communication with a respective fluid reservoir 402 and 404. In general, the pumps 406 and 408 serve to pump fluid from the fluid reservoirs 402 and 404, respectively, to a location where the fluids are dosed onto a wipe. Any suitable pump can be employed, and the pump and its components can be made of any material(s) compatible with the fluid to be pumped, examples of which include any type of plastic. In one example embodiment, one or both of the pumps 406 and 408 is a Bellows Metering Pump manufactured by GRI. Details concerning these example pumps are disclosed in Appendix A hereto, which is incorporated herein in its entirety by this reference. Any other pumps of comparable functionality could be substituted however.

In some particular embodiments, and with reference to the example pump 406 in particular, one or more of the pumps can take the form of a pump which, in general, is configured such that a movement of the lid 104 results in the discharge of fluid to a location where the fluid can be dosed onto a wipe. For example, the pump 406 includes a bellows 407 that can be used to cause the operation of the pump 406. Further details concerning operational aspects of the example pumps 406 and 408 are provided below. It should be noted that while the following discussion is directed to pump 406, the configuration and arrangement of pump 408 can be similar, or identical, to that of pump 406. Thus, the following discussion is equally applicable to pump 408.

As shown in the Figures, the pump 406 includes a suction connection 410 and a discharge connection 412. A pump suction line 414 connects the fluid reservoir 402 with the suction connection 410. A backflow preventer 416, such as a check valve, for example, is provided in the pump suction line 414 to prevent backflow of fluid from the pump suction line 414 into the fluid reservoir 402. A pump discharge line 418 connects the pump discharge connection 412 with a fluid discharge manifold 420 that is configured and arranged to direct discharged fluid from the pump 406 onto a wipe as the wipe is dispensed from the wipe dispensing system 100. A backflow preventer 422, such as a check valve, for example, is provided in the pump discharge line 418 to prevent backflow of fluid from the fluid discharge manifold 420 into the pump 406.

In terms of its operation, the bellows 407 of the pump 406 has a variable volume and, when that volume is reduced by compression of the bellows 407, the resulting pressure is exerted on a fluid disposed within a fluid chamber of the pump 406, causing the fluid to be discharged from the pump 406 by way of the pump discharge line 414. The interior of the bellows 407 may, or may not, be in fluid communication with the fluid chamber of the pump 406. In either case however, the bellows 407 is configured and arranged to exert a pressure on the fluid in the fluid chamber. When the compressive force is released from the bellows 407, the bellows 407 expands and returns to the configuration shown in FIG. 14, for example. As a result of the release of the compressive force, such as occurs when the lid 104 is released at the completion of a wipe dosing and dispensing process, a vacuum, or negative pressure, is created in the fluid chamber of the fluid pump 406.

In particular, the expansion of the bellows 407 increases the volume of the bellows 407, causing the pressure in the empty fluid chamber to drop below the pressure in the fluid reservoir 402 and, as a result, fluid from the fluid reservoir 402 enters the fluid chamber of the pump 406 by way of the pump suction line 414. This fluid is prevented from flowing back to the fluid reservoir 402 by the backflow preventer 416 and thus remains in the pump 406. After the fluid chamber of the pump 406 has been refilled in this way, the wipe dispensing system 100 is once again in the 'ready' state.

Figure 12:
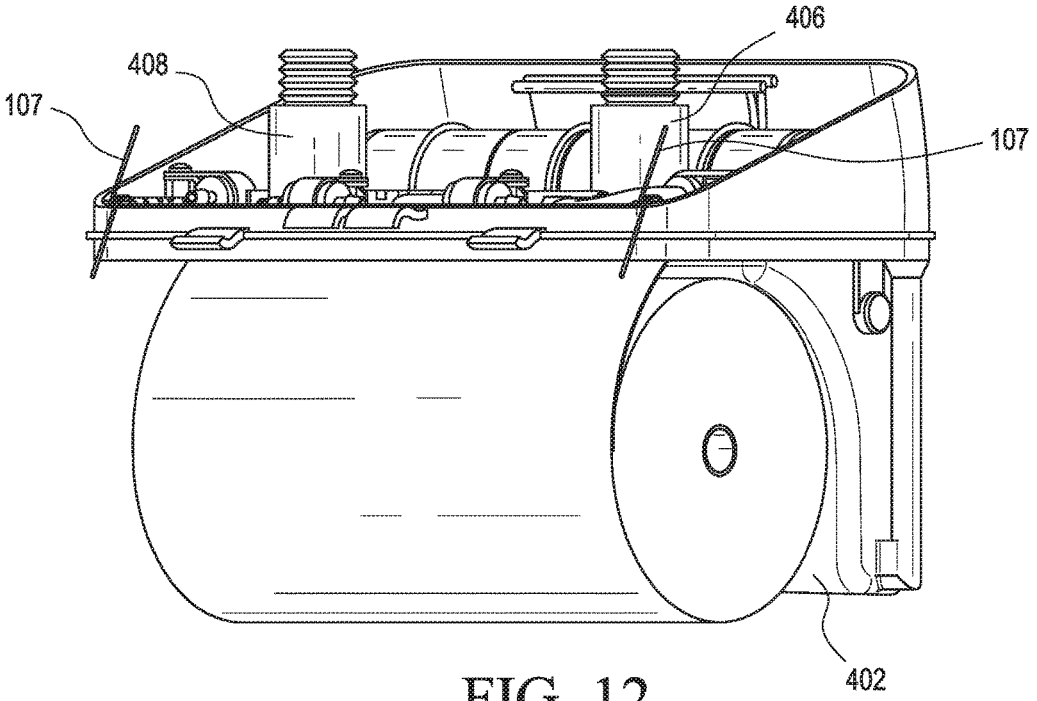
FIG. 12 is a rear perspective view of various fluid system components of an example on demand wet wipe dispensing system.
Figure 13:
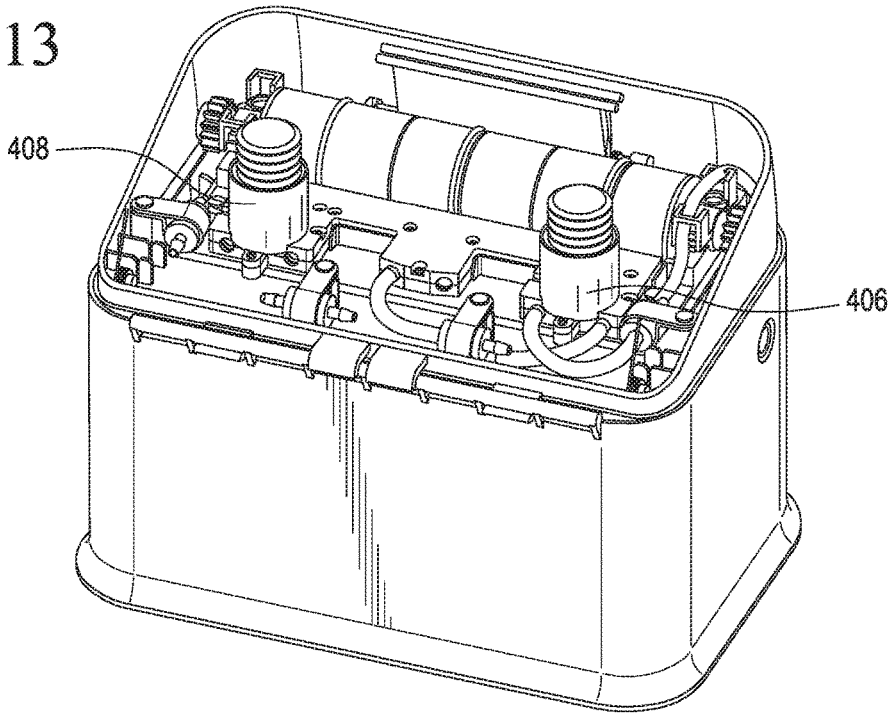
FIG. 13 is a top perspective view of various fluid system components of an example on demand wet wipe dispensing system.
Figure 14:
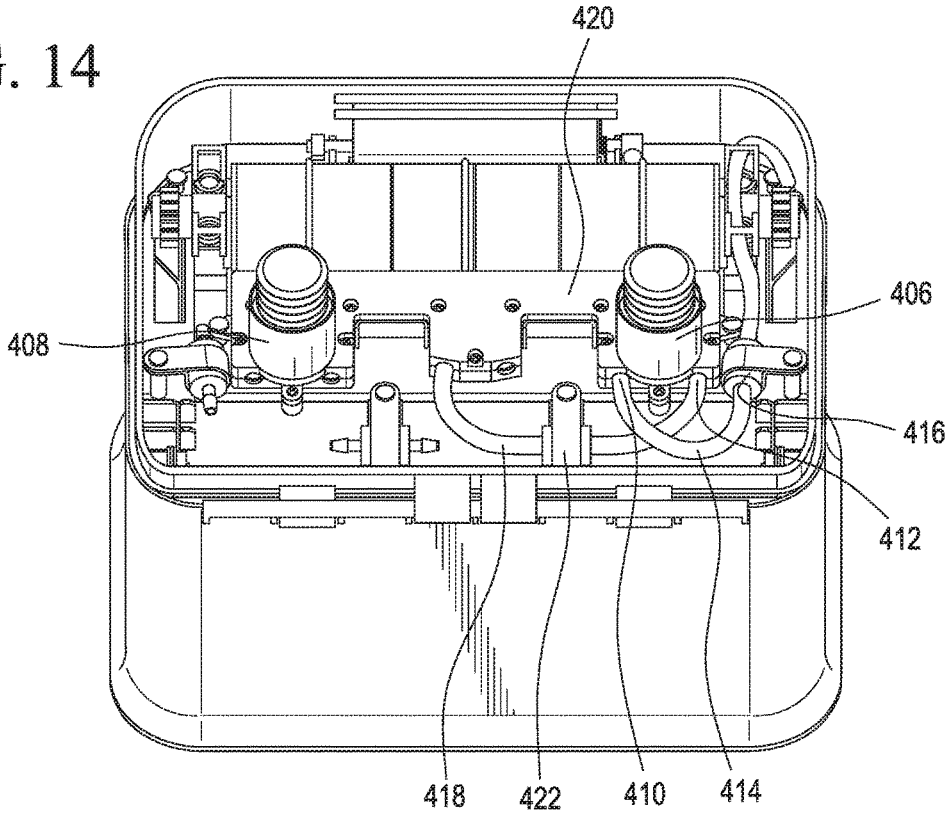
FIG. 14 is a top view of various fluid system components of an example on demand wet wipe dispensing system.
Figure 15:
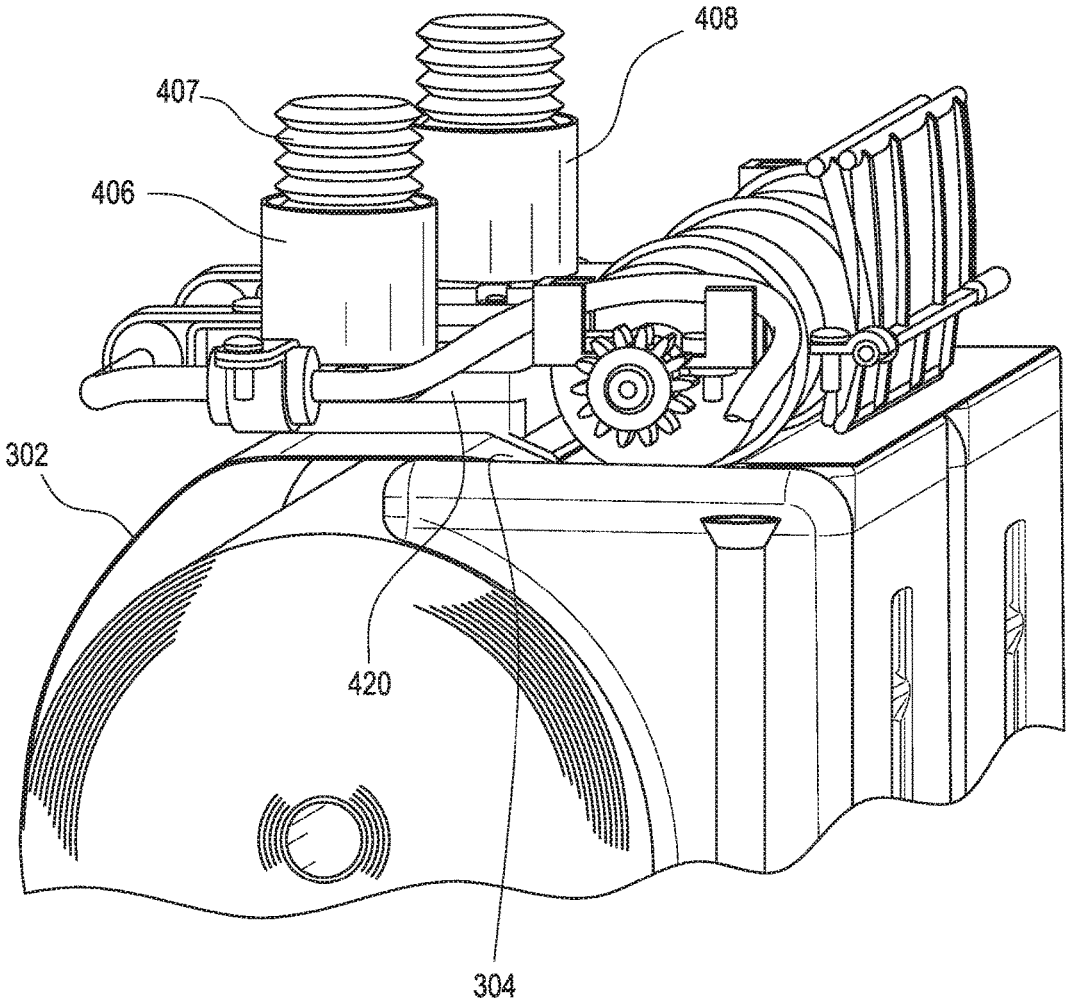
FIG. 15 is a front perspective view of various fluid system components of an example on demand wet wipe dispensing system.

With particular reference now to FIGS. 12-14, it can be seen that many components of the fluid dispensing system 400 can be positioned on or in the housing extension 110. For example, any one or more of the pumps 406 and 408, the fluid discharge manifold 420, the pump suction and discharge lines 414 and 418, and the backflow preventers 416 and 422 can all be mounted, directly or indirectly, to a bottom of the housing extension 110. When the lid 104 is positioned as shown, for example, in FIG. 1, the lid 104 and housing extension 110 cooperatively define an enclosure within which the aforementioned components are disposed. More generally, the fluid dispensing system 400, as well as the supply 300 of wipes, can be completely enclosed within enclosures defined by one or more of the lid 104, housing extension 110, and housing 102.

This self-contained configuration may allow the wipe dispensing system 100 to be readily mounted to a wall, table, or other structure, and can also enable the wipe dispensing system 100 to be readily moved from one location to another. Moreover, this self-contained configuration can also help to reduce the ingress of foreign material to the wipe dispensing system 100. Finally, the self-contained configuration of the wipe dispensing system 100 hides most of the components of the fluid dispensing system 400 and the wipe dispensing system 200 from view. This results in a relatively clean look that may be appealing to a user, and may also reduce the likelihood that the aforementioned components will be tampered with.

Turning now to FIGS. 15-18, further details are provided concerning the example fluid dispensing system 400. As shown, the fluid discharge manifold 420 of the fluid dispensing system 400 is positioned proximate wipe path 304. This configuration and arrangement enables the fluid discharge manifold 420 to direct fluid onto a wipe 302 disposed in the wipe path 304. In more detail, the fluid discharge manifold 420 defines an internal fluid chamber 424 that is in fluid communication with the pump discharge line 418 such that fluid discharged by the pump 406 enters the fluid chamber 424 of the fluid discharge manifold 420. Because the pump 408 is also in fluid communication with the fluid chamber 424, the respective fluids discharged from the pumps 406 and 408 can mix together in the fluid chamber 424 before being dispensed onto a wipe. This mixing can help to avoid over-concentration of a fluid on the wipe.

The fluid discharge manifold 420 further includes an outlet 426 that is open to the atmosphere. In some embodiments, multiple outlets 426 are provided. The outlet 426, which can take the form of a lengthwise slit in the fluid discharge manifold 420, is in fluid communication with the fluid chamber 424. In some embodiments, the length of the slit that forms the outlet 426 may about the same as the width of the wipe, or slightly less. As such, at least some configurations of the outlet 426 can enable relatively even distribution of one or more fluids with respect to the width of the wipe.

Figure 17:
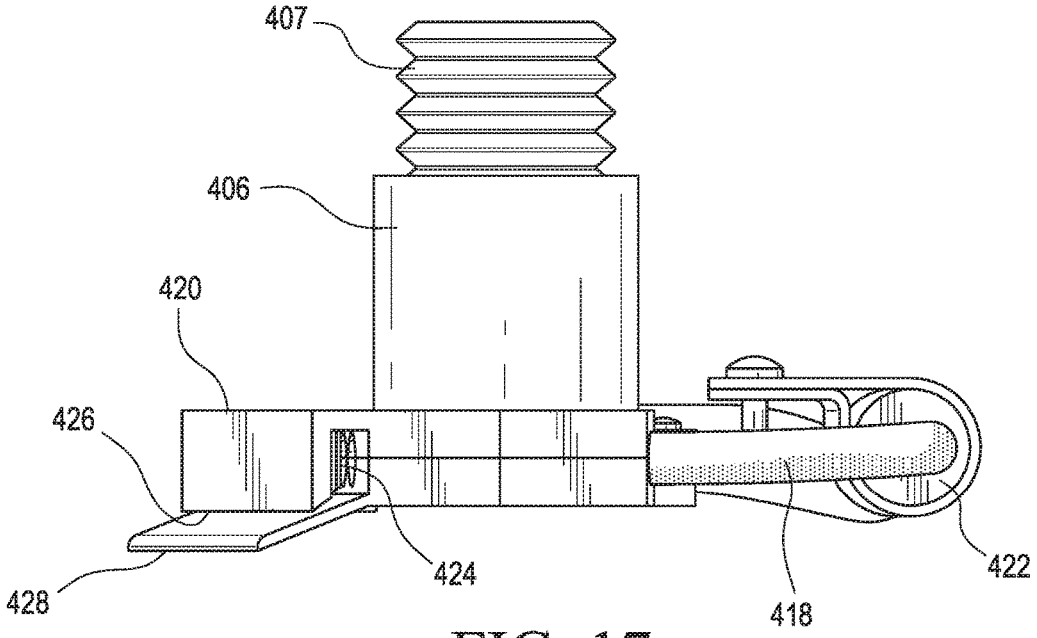
FIG. 17 is a detail perspective view of various fluid system components of an example on demand wet wipe dispensing system.
Figure 18:
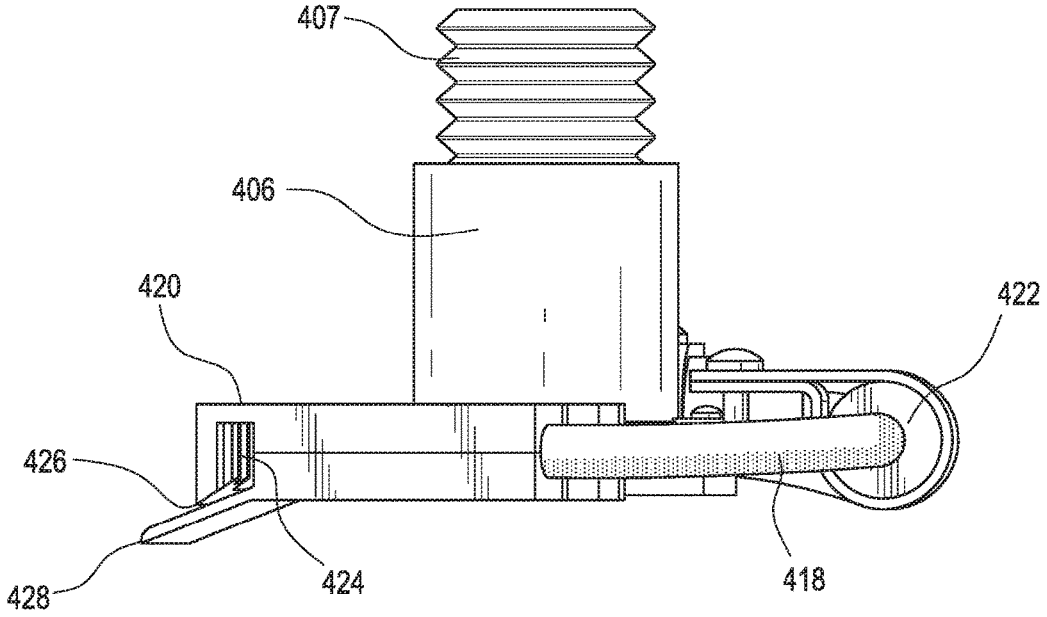
FIG. 18 is another detail perspective view of various fluid system components of an example on demand wet wipe dispensing system.

As best shown in FIGS. 17 and 18, the fluid discharge manifold 420 can include a guide 428 that, in the illustrated example, takes the form of a downwardly extending ramp. In general, the guide 428 serves to direct fluid from the outlet 426 to the wipe path 304. When a wipe 302 is positioned in the wipe path 304, the fluid runs off the guide 428 onto the wipe 302. In some embodiments, the guide 428 can comprise, or be coated with, a hydrophobic material, such as a hydrophobic plastic, that tends to prevent fluid from collecting on the guide 428. While not specifically illustrated, the guide 428 can include one or more channels, slots, or similar features, extending downward toward the wipe path 304 and that aid in directing fluid to the wipe path 304.

Figure 16:
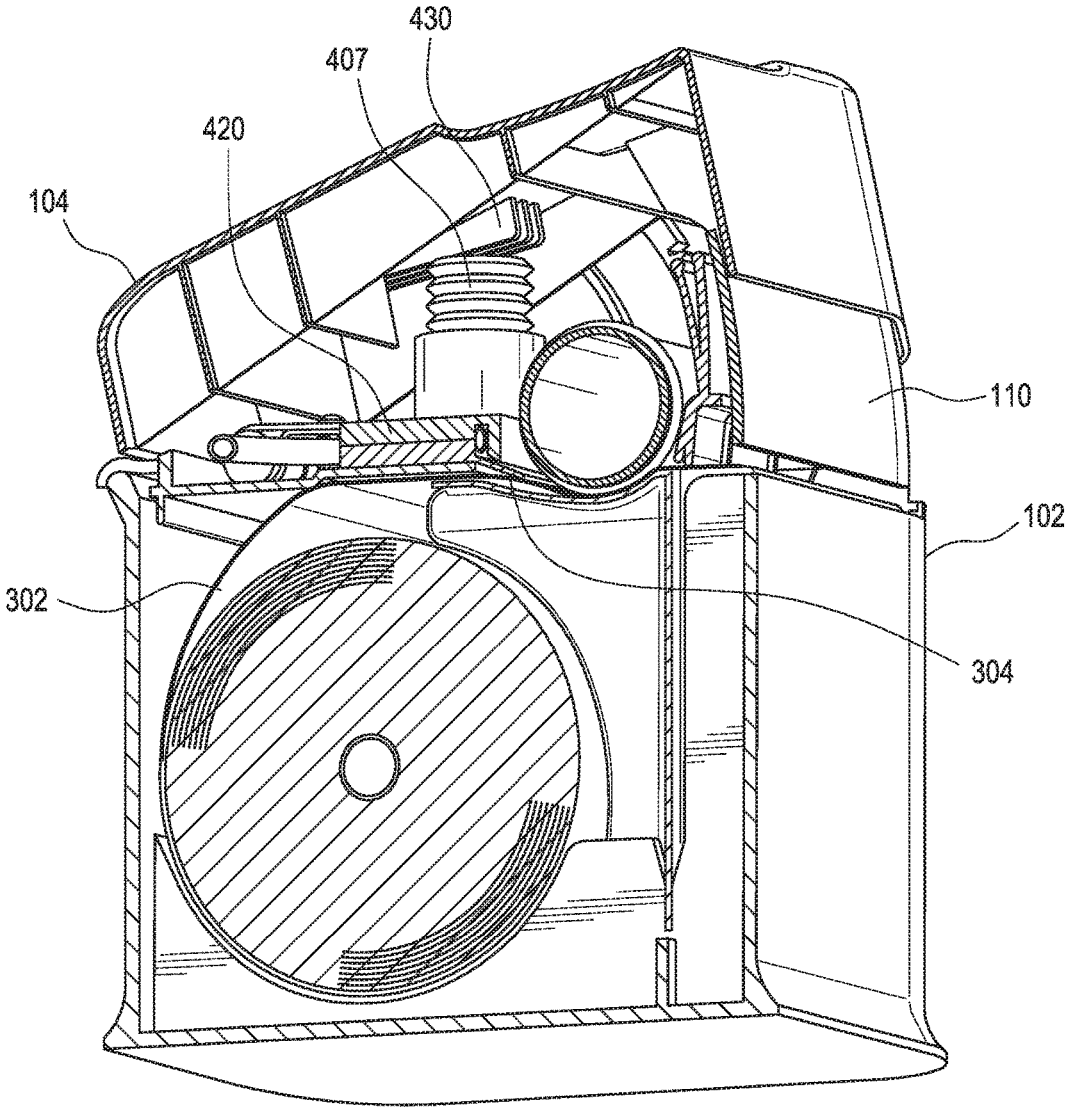
FIG. 16 is a section view of an example on demand wet wipe dispensing system.

With particular reference now to FIGS. 4, 14 and 16, the lid 104 can include one or more pump actuators 430 that can be integral with the lid 104, although that is not required. In general, the pump actuators 430 are structural elements configured and arranged to selectively cause the operation of a pump 406. In the illustrated example, the pump actuator 430 is configured and arranged for selective contact with an upper portion, such as the bellows 407 for example, of a pump 406. When the bellows 407 is compressed by the pump actuator 430, as may occur when a user pushes the lid 104 down as part of a wipe dosing and dispensing process, fluid in a fluid chamber of the pump 406 is pressurized and then discharged to the fluid discharge manifold 420 by way of the discharge line 418. When the lid 104 returns to the position shown in FIG. 1, such as under the influence of a biasing force brought to bear after the completion of a wipe dosing and dispensing operation, the pump actuator 430 moves away from the bellows 407, allowing the bellows 407 to return to a fully expanded state. At about the same time, the fluid chamber 406 of the pump is refilled, as described elsewhere herein, and the wipe dispensing system 100 is again in the 'ready' state.

D. OPERATION OF A WIPE DISPENSING SYSTEM

With reference to the various Figures discussed above, details are now provided concerning some operations of an example wipe dispensing system. While the following discussion refers to a single pump and fluid reservoir, the described operations can also be performed in connection with multiple pumps and respective fluid reservoirs and, as such, multiple fluids can be dosed onto a wipe substantially simultaneously.

Initially, the wipe dispensing system can be in a 'ready' state where the wipe dispensing system is able to dispense a wipe on demand. See, e.g., FIG. 1, in which the lid is biased upward into the indicated position. In the 'ready' state, the wipe is positioned in the wipe path such that a leading edge of the wipe that will be dispensed is located proximate the outlet of the fluid discharge manifold. As well, when the wipe dispensing system is in the 'ready' state, a volume of fluid may reside in a fluid chamber of a pump.

The fluid chamber and/or other components of the pump can be sized to provide a dose of a particular volume. Where multiple pumps and fluid chambers are provided, the dose volume provided by each can be the same, or may be different. Because the pumps can provide relatively precise dosage amounts, the ability to select dose sizes and, thus, dosing ratios for multiple fluids, enable the chemistry of a particular fluid, or combination of fluids, to be tuned, for example, to a desired pH, color, and/or concentration.

In any case, the user can then depress the lid of the wipe dispensing system, overcoming the bias imposed by a torsion spring, for example, on the lid. As described earlier, the downward movement of the lid causes the roller to rotate and advance the wipe along the wipe path. At, or about, the same time, the lid also operates the pump, such as by compression of a bellows for example, causing the pump to discharge fluid to the fluid discharge manifold, which then directs the fluid to the wipe as the wipe passes below the fluid discharge manifold.

Thus, in example embodiments of the invention, a wipe is dosed, by one or more liquids, and dispensed at the same time, or about the same time, by a single operation of the user, namely, a depression of the lid. Moreover, the lid is returned automatically to a 'ready' position after it is released by the user at the conclusion of a dosing and dispensing event.

With regard to the volume of fluid dispensed during a wipe dispensing event, that volume can be a function of a number of variables, including the pressure exerted by the pump, the internal diameter of the fluid conduit, and the volume of the fluid chamber inside the pump. By appropriately selecting the fluid system components, a relatively high degree of accuracy can be obtained with regard to the amount of fluid dispensed. As well, the duration of time over which the fluid is dispensed can be about the same amount of time it takes for a wipe to be completely dispensed from the wipe dispensing system. Further, the wipe dispensing system can dispense fluid during an entire wipe dispensing event or during only part of the wipe dispensing event. The amount of time taken by the dosing process can be adjusted in various ways such as, for example, by adjusting the dose amount. Thus, a relatively small dose amount may be dispensed before the wipe dispensing event is completed, while a relatively larger dose amount may be dispensed during all, or nearly all, of the wipe dispensing event. Moreover, the fluid dispensing system can be configured so that dosing of the wipe is completed before the wipe is completely dispensed. In this way, there is adequate time for the wipe to absorb all of the dispensed fluid, thereby helping to ensure that there is no fluid remaining that could drip downward onto the supply of wipes that have not yet been dispensed.

As well, variables such as the pressure, velocity, and flow rate of the fluid can vary depending upon the rate at which the wipe is dispensed. For example, if the wipe is gradually dispensed at a relatively consistent rate, the pressure, velocity and flow rate of the fluid may likewise be relatively consistent over the wipe dispensation process. On the other hand, if the wipe is dispensed at a rate that varies, the pressure, velocity and flow rate of the fluid may correspondingly vary over the wipe dispensation process. For example, those parameters may start at relatively low values and then quickly move to higher values if the wipe is dispensed quickly. Thus, regardless of the manner in which the wipe is dispensed during a wipe dispensing event, the wipe dispensing system is able to respond and adjust to the wipe dispensing event and adequately dose the wipe with the fluid(s).

As explained in the present disclosure, including the foregoing discussion concerning aspects of the operation of the lid 104 and its components, lid 104 is an example structural implementation of a means for causing simultaneous on-demand dosing and dispensing of a wipe. Moreover, such a means is responsive to user input, that is, this means can cause performance of the dosing and dispensing functions in response to a single user action, such as depression of the lid. Other functions performed by such a means also include simultaneous operation of two or more pumps, and operation of a wipe dispensing system.

As well, the disclosed embodiments of a wipe dispensing system are example structural implementations of a means for dispensing a wipe. Moreover, such a means is responsive to user input, that is, this means can dispense the wipe in response to a single user action, such as depression of the lid. This function of dispensation of the wipe can be performed on-demand as a result of the user input, and can be performed simultaneous with dosing of the wipe, such as by a fluid dispensing system.

As well, the disclosed embodiments of a fluid dispensing system are example structural implementations of a means for dosing a wipe. Moreover, such a means is responsive to user input, that is, this means can dose the wipe in response to a single user action, such as depression of the lid. This function of dosing of the wipe, which can involve one, two, or more, fluids, can be performed on-demand as a result of the user input, and can be performed simultaneous with dispensing of the wipe, such as by a wipe dispensing system.

With respect to the various aforementioned means, it is noted that the foregoing structures are provided only by way of example, and any other structure(s) of comparable functionality may alternatively be employed.

Various aspects of the fluid dispensing system can be modified to achieve corresponding effects. For example, in one alternative embodiment, a split lid is provided that includes two similar, or identical, halves. The halves can be mirror images of each other. Each lid half is independently operable to control a respective fluid dispensing system and a wipe dispensing system, each of which can be similar or identical to any disclosed embodiment of such systems, so that a single wipe dispensing unit can be employed by a user to dispense at least two wipes having different respective chemistries. The lid halves can be color coded or otherwise include indicia that informs the user of the type of chemistry employed in the wipes that are dispensed by operation of that lid half.

In another example embodiment, the fluid discharge manifold can be fitted with, or replaced by, an array of nozzles. In this example embodiment, the array of nozzles would direct fluid from one or more pumps to a wipe located in the wipe path. Specific dosing effects could be achieved by variations to the size, number, orientation and placement of the nozzles in a particular array.

E. ASPECTS OF SOME EXAMPLE METHODS

Figure 19:
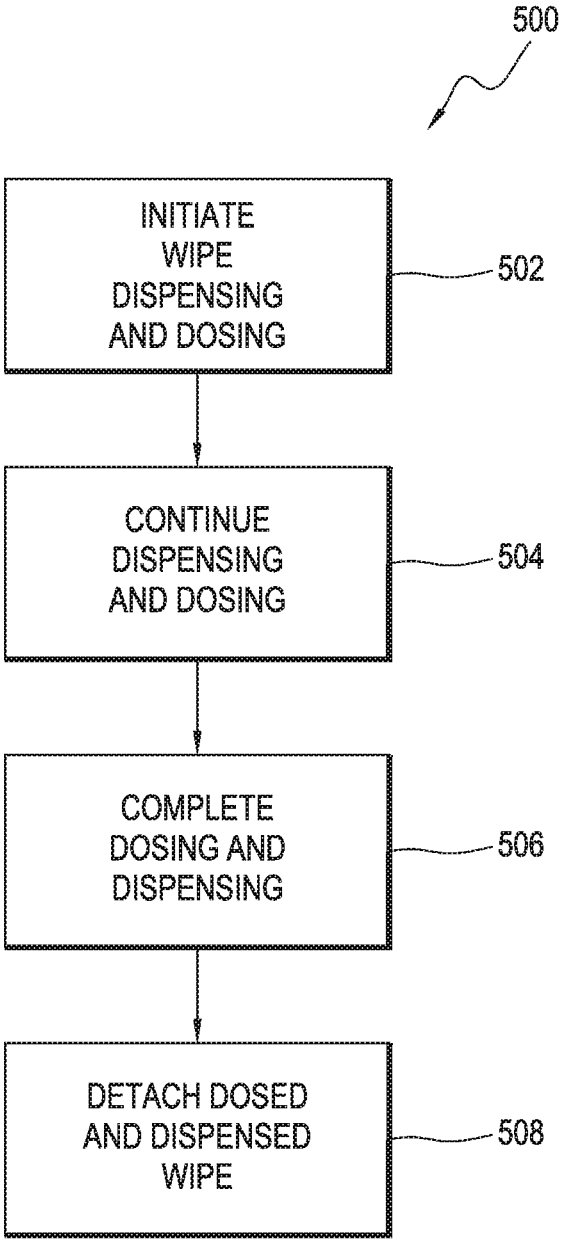
FIG. 19 is a flow diagram disclosing aspects of an example method of use for an on demand wet wipe dispensing system.

With continued reference to the Figures, and directing attention now to FIG. 19, details are provided concerning a method of use of an example wipe dispensing system, where one example of such a method is denoted generally at 500. The method 500 can provide for on-demand dosing and dispensing of one or more wipes.

The method 500 can begin when dispensation of a wipe is initiated 502. This initiation 502 can occur when, for example, a user begins to depress a lid of a wipe dispensing system. The wipe may be dry loaded, loaded and substantially dry (e.g. dry to the touch), or dry and un-dosed, prior to the initiation 502 of the dispensation of the wipe. Simultaneously with, or at about the same time as, initiation 502 of the dispensation of the wipe, dosing of the wipe may begin.

After initiation 502 of the wipe dispensation and dosing, the user can continue to depress the lid of the wipe dispensing system so as to continue 504 the dispensing and dosing processes. If the user should stop the downward motion of the lid prior to full dosing and dispensation of the wipe, or release the lid so that the lid returns to the 'ready' position, the dosing and dispensing of the wipe will cease unless or until such time as the user begins to press the lid downward. The wipe may be progressively dosed by one or more fluids as a result of the dispensation of the wipe 504 from the wipe dispensing system. Thus, the process 504 can involve movement of a wipe that is wet in one portion, such as the portion that has passed by the fluid discharge manifold, and dry in another portion, such as the portion that has not passed beneath the fluid discharge manifold.

In some instances, the user can obtain a partly dosed wipe by pressing the lid less than fully downward. After the lid has been depressed to the extent desired by the user, the wipe, which may then partly extend from the housing of the wipe dispensing system, can then be detached by the user. Such a wipe may thus comprise a dosed portion and an un-dosed portion.

At 506, the user can complete the dosing of the wipe and the dispensation of the wipe from the wipe dispensing system. In some embodiments, completion of the dispensation of the wipe refers to a state in which most, or all, of the dosed wipe, extends out of the housing of the wipe dispensing system, such as when the user has fully depressed the lid of the wipe dispensing system. At this juncture, the wipe has been dosed with one or more fluids such that a substantial portion of the wipe has been wetted with the fluid(s). Thus, the process 506 can involve completion of the dispensation of a fully dosed wipe from the wipe dispensing system. When the wipe has been fully dosed and dispensed, the user can then grasp the wipe and detach it 508 from the next succeeding wipe.

As will be apparent from the foregoing, the processes 502, 504 and 506 can be caused by a single user action, namely, full depression of the lid of the wipe dispensing system. Moreover, those processes can all be performed without requiring the user to touch, grasp, tear, pull, or otherwise manipulate, the wipe before it is completely dosed and dispensed. As well, it should be noted that the lid of the wipe dispensing system can be fully depressed repeatedly to dose and dispense a succession of wipes, which can remain attached to each other, or which can be detached from each other by a user.

Figure 20:
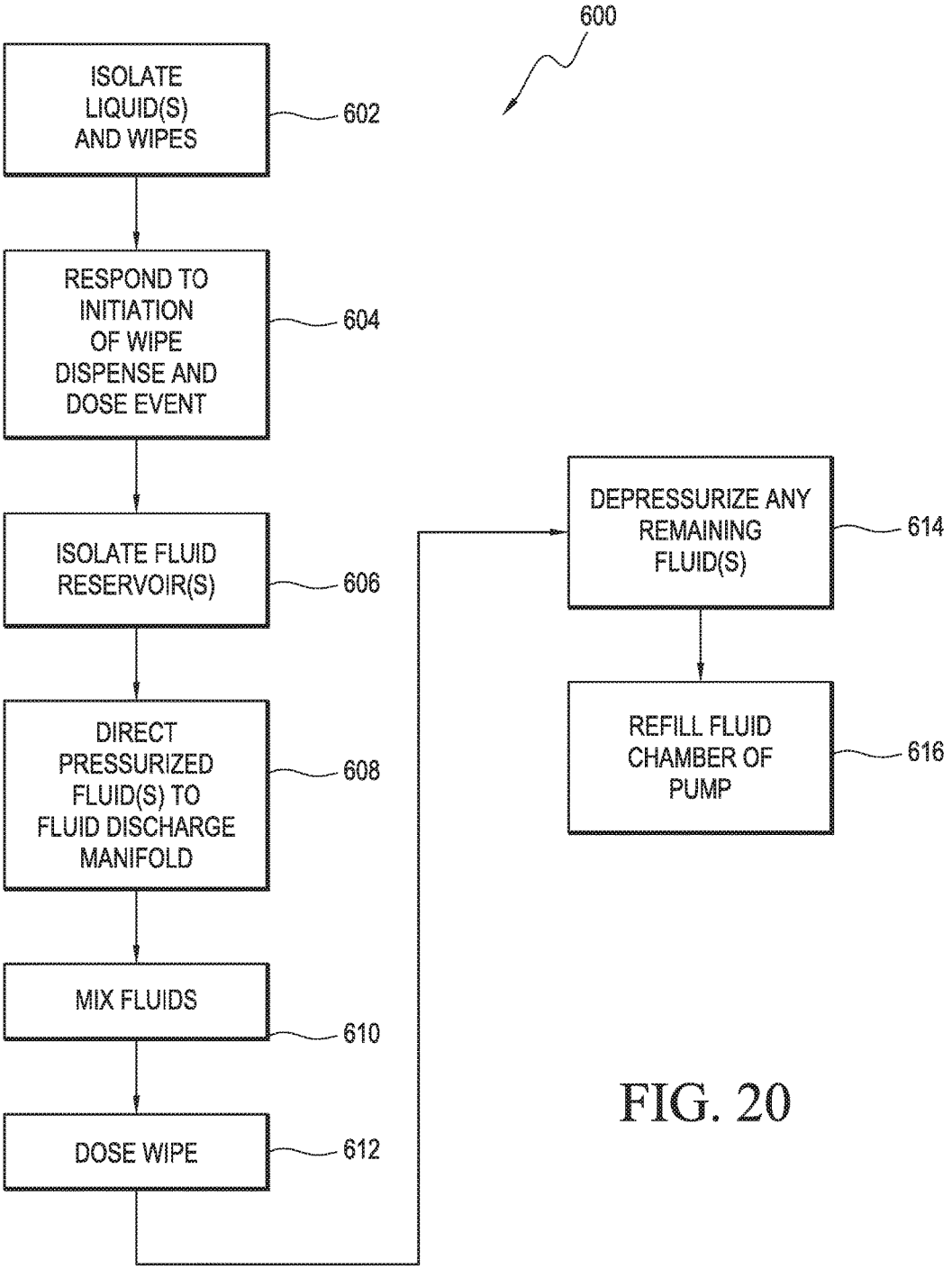
FIG. 20 is a flow diagram disclosing aspects of an example method of operation of an on demand wet wipe dispensing system.

With continued reference to the Figures, and directing attention now to FIG. 20, details are provided concerning a method of operation of an example wipe dispensing system, where one example of such a method is denoted generally at 600. While the following discussion generally refers to a fluid dispensing system that includes multiple pumps and fluid reservoirs, it should be understood that the method can involve the operation of a single fluid reservoir and pump.

The method 600 can begin by isolating 602 one or more fluids and a supply of wipes from each other so that the fluids do not mix with each other or with the wipes until a dosing and dispensing process is initiated. Next, the method 600 advances to responding 604 to initiation of a wipe dispensing event. The response 604 can include pressurization of one or more fluids that are each stored in a respective fluid chamber in isolation from each other. Such pressurization can be in addition to pressurization of the fluid that naturally occurs as a result of a static pressure head imposed on the fluid by gravity. At about the same time, or subsequent to, the pressurization of the fluid in the fluid chamber, an associated fluid reservoir can be isolated 606 so that the pressurized fluid does not reenter the fluid reservoir. This isolation 606 can take the form of operation of a backflow preventer.

When the fluid reservoir has been isolated 606, the pressurized fluid can then be directed 608 from a discharge side of a pump to a fluid discharge manifold that is in fluid communication with the discharge side of the pump. Where multiple fluids are involved, the fluids can be mixed 610 in the fluid discharge manifold and/or as they exit the discharge manifold as part of the dosing 612 of a wipe.

As well, the dosing 612 process can be performed substantially simultaneously with dispensation of the wipe such that the dosing 612, with one or more fluids, occurs as the wipe is dispensed. That is, mixing of the fluid takes place on-demand as the wipe is dispensed, and not before. Finally, dispensation and dosing of the wipe can be performed as a single action by a user.

As a result of the dosing 612 of the wipe, any remaining fluid that has not been dosed 612 onto the wipe is depressurized 614. After depressurization, any remaining fluid may be pressurized, if at all, only by static pressure head imposed on the fluid by gravity. Contemporaneously with the depressurization 614, the fluid chamber can be refilled 616 in preparation for the next wipe dispensing event.

F. EXAMPLE WIPE MATERIALS AND FLUID CHEMISTRIES

In connection with embodiments such as those disclosed herein, a variety of different wipe substrate materials and dosing fluids can be employed. The scope of the invention is not limited to any particular substrate materials, dosing fluids, or combinations of these and, as such, the substrate materials and fluids discussed below are provided only by way of illustration, and not limitation.

Some general examples of wipe substrates include one or more of the following, in any combination: dry (un-dosed); wet (pre-dosed); dry (pre-dosed); wet or dry pre-dosed with fluid(s) and/or particles; synthetic; non-synthetic, such as cellulose for example; and, blends of synthetic and non-synthetic. Some particular embodiments of the invention allow the use of, for example, cellulose wipes with oxidants that are currently not possible due to chemical and/or wipe degradation.

As noted herein, embodiments of the invention may be advantageous in that, for example, the wipe dispensing system enables new chemistry that can be delivered onto a surface by a wipe. The chemical combinations are enabled as the fluids are mixed as the wipe is dispensing, therefore the fluids are in contact with each other for a substantially shorter period of time than in the case of traditional wet wipes.

In addition, embodiments of the invention implement the separation of both fluids from the wipe until the time that the wipe is dispensed. As a result, the problem of modification of the fluid when stored with the wipe over a long period of time is avoided. As an example, sodium hypochlorite exhibits higher stability at a relatively high pH. However, the micro efficacious profile of sodium hypochlorite is lower at the higher pH. Thus, example embodiments of the invention enable the activation of stable sodium hypochlorite into the less stable, yet highly efficacious, hypochlorous acid.

Sample Formula 1:

| Ingredient | Examples | Range of Wt % Active |
|---|---|---|
| | Fluid A | |
| Alkali Hypochlorite | Sodium Hypochlorite | 0.20-1.0% |
| Alkaline Buffer | Sodium Carbonate, Sodium Hydroxide | 0.01-1.0% |
| Water DI | | Balance |
| | Fluid B | |
| pH Regulators | Sodium Citrate, Citric Acid Anhydrous, Succinic Acid | 0.20-1.5% |
| Organic Slashing Agent | Sodium Citrate Dihydrate, Citric Acid Anhydrous, Succinic Acid | 0.30-0.90% |
| Surfactants/ Hydrotropes | Sodium Xylene Sulfonate, Decyl (Sulphophenoxy) Benzene Sulphonic Acid, Disodium Salt | 0-2.0% |
| Fragrance | | 0-0.10% |
| Water DI | | Balance |

Sample Formula 2:

| Ingredient | Examples | Range of Wt % Active |
|---|---|---|
| | Fluid A | |
| Alkali Hypochlorite | Sodium Hypochlorite | 0.20-1.0% |
| Alkaline Buffer | Sodium Carbonate, Sodium Hydroxide | 0.01-1.0% |
| Water DI | | Balance |
| | Fluid B | |
| Buffer | Sodium Bicarbonate | 0.10-1.0% |
| Inorganic Slashing Agent | Sodium Nitrite, Sodium Thiosulfate | 0.30-0.90% |
| Surfactants/ Hydrotropes | Sodium Xylene Sulfonate, Decyl (Sulphophenoxy) Benzene Sulphonic Acid, Disodium Salt | 0-2.0% |
| Fragrance | | 0-0.10% |
| Water DI | | Balance |

Sample Formula 3:

| Ingredient | Examples | Range of Wt % Active |
|---|---|---|
| | Fluid A | |
| Water DI | | 100% |
| | Fluid B | |
| Peracetic Acid | | 0.20-1.0% |
| Peroxide | Hydrogen Peroxide | 0.30-0.90% |
| Acetic Acid | | 2-5.0% |
| Surfactants/ Hydrotropes | Secondary Alkane Sulfonates, Alcohol Ethoxylates, EO/PO Surfactants | 0-2.0% |
| Solvent | Monohydric Alcohols | 0-2.0% |
| Fragrance | | 0-0.10% |

Alternatives to the described fluid components above are an oxidant in one fluid reservoir, with organic components in a water based fluid in a second fluid reservoir. Example organic components include, but are not limited to fragrances, surfactant, and polymers. Another multi-fluid combination that is enabled by example embodiments of the invention is chemistry that is stable as a concentrate but desired use is as a diluted version.

It should be noted that as used here, the term 'fluid' is intended to be broad in scope. As such, that term embraces any material, and any combination of two or more materials, that can be employed by a fluid dispensing system, examples of which are disclosed herein. Moreover, materials of various viscosities and other properties can be used. As such, examples of materials include fluids having a room temperature viscosity about the same as water, as well as lotions, slurries, soaps, ointments, and other materials whose room temperature viscosity may be greater than that of water.

Where combinations of materials are employed in an embodiment, any ratio or percentage of those materials can be employed. By way of illustration, if two fluids are employed in an embodiment, the percentage (e.g., by volume) of the first fluid can be anywhere in the range of about 1% to about 99% and, accordingly, the percentage (e.g., by volume) of the second fluid can be anywhere in the range of about 99% to about 1%.

As will be apparent from the foregoing discussion and examples, the wipe dispensing system can be configured to dispense a fluid combination whose pH is different from the respective pH values of the constituent components. For example, where one of the components is relatively stable bleach, that component can be combined with one or more other fluids at about the time that dispensation of the wipe is initiated. The combined fluid thus produced can have a pH that renders it more active than the bleach component alone.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed:

1. A wipe dispensing system, comprising:

a housing that defines an internal wipe storage area;

a lid rotatably connected to the housing;

one or more push arms connected to the lid;

a friction bar in contact with said one or more push arms;

a fluid reservoir disposed within the housing;

a pump in fluid communication with the fluid reservoir;

a fluid discharge manifold in fluid communication with the pump and arranged proximate to a portion of a wipe dispensing path, wherein the lid is operably disposed with respect to the pump such that depression of the lid causes discharge of fluid from the pump through the fluid discharge manifold, and also moves said one or more push arms into contact with the friction bar causing rotation of the friction bar allowing for dispensation of a wipe from the housing.

2. The wipe dispensing system as recited in claim 1, wherein the lid is biased into a ready position by a biasing element.

3. The wipe dispensing system as recited in claim 1, wherein the wipe dispensing system defines the wipe dispensing path and a fluid flow path that intersect each other such that the wipe is dosed with fluid as the wipe is dispensed from the housing.

4. The wipe dispensing system of claim 1, further comprising a housing extension rotatably connected to the housing and arranged to close a gap between the housing and the lid when the lid resides in a ready position.

5. The wipe dispensing system as recited in claim 1, further comprising an additional fluid reservoir and pump, both of which are disposed in the housing, and the additional pump is in fluid communication with the fluid discharge manifold.

6. The wipe dispensing system as recited in claim 5, wherein depression of the lid causes discharge of fluid from the additional pump through the fluid discharge manifold.

7. A wipe dispensing system, comprising:

a housing defining a wipe storage area;

a lid connected to the housing;

a drive gear connected to the lid;

a driven gear engaged with the drive gear;

a roller that is connected to the driven gear;

a fluid reservoir disposed within the housing;

a pump in fluid communication with the fluid reservoir; and a fluid discharge manifold in fluid communication with the pump, wherein the lid is operably disposed with respect to the pump such that depression of the lid moves said drive gear causing rotation of the driven gear and the roller resulting in simultaneous dosing and dispensing of a wipe from the housing.

8. The wipe dispensing system as recited in claim 7, further comprising an additional fluid reservoir and pump, both of which are disposed in the housing, and the additional pump is in fluid communication with the fluid discharge manifold.

9. The wipe dispensing system as recited in claim 7, further comprising one or more push arms connected to the lid and a friction bar in contact with said one or more push arms.

10. The wipe dispensing system as recited in claim 6, further comprising a housing extension rotatably connected to the housing and arranged to close a gap between the housing and the lid when the lid resides in a ready position.

* * * * *